US006402154B1

(12) United States Patent
Hess et al.

(10) Patent No.: US 6,402,154 B1
(45) Date of Patent: Jun. 11, 2002

(54) SIMULATED FOOTBALL GAME

(76) Inventors: Michael Hess, 214 Bash Rd.; Daniel C. Warner, 23 Longman St., both of Toms River, NJ (US) 08753

( * ) Notice: Subject to any disclaimer, the term of this patent is extended or adjusted under 35 U.S.C. 154(b) by 0 days.

(21) Appl. No.: 09/736,685

(22) Filed: Dec. 15, 2000

(51) Int. Cl.[7] ..... A63F 7/20; F41J 3/00

(52) U.S. Cl. ..... 273/317.5; 273/408; 273/409

(58) Field of Search ..... 273/317.5, 403, 273/404, 407, 408, 409, 371–376; D21/307, 308

(56) References Cited

U.S. PATENT DOCUMENTS 2,227,382 A * 12/1940 Salter ..... 273/317.5
2,458,388 A * 1/1949 Kobs ..... 273/247
3,979,117 A * 9/1976 Worsham ..... 273/317.5
4,009,679 A * 3/1977 Kircher ..... 116/225
D285,942 S * 9/1986 Kemmeter ..... D21/307
D291,098 S * 7/1987 O'Connor ..... D21/307
4,681,325 A * 7/1987 Sheem ..... 273/317.5
D293,455 S * 12/1987 Castro et al. ..... D21/308
4,893,822 A * 1/1990 Tesa et al. ..... 273/376
5,664,782 A * 9/1997 Lacks et al. ..... 273/317.5
5,967,518 A * 10/1999 Rowe ..... 273/317.5
5,979,898 A * 11/1999 Pan ..... 273/371
D444,505 S * 7/2001 McGinnis ..... D21/308

* cited by examiner

*Primary Examiner*—Mark S. Graham
(74) *Attorney, Agent, or Firm*—Louis S. Gillow

(57) ABSTRACT

A dartboard adapted for playing the game of american football includes a quadrilateral simulated football field section; a quadrilateral downs section; a quadrilateral punts section; and a quadrilateral kicks section; whereby opposing players or teams accumulate scores by projecting darts in sequence in order to achieve a total winning score within a previously agreed time period.

1 Claim, 4 Drawing Sheets

SIMULATED FOOTBALL GAME

FIELD OF THE INVENTION

The present invention relates to a dartboard for playing a simulated game of american football.

BACKGROUND OF THE INVENTION

The ancestor of all footballs games is soccer, but rugby, an offshoot of soccer, served as the basis for american football.

Rugby was invented in 1823 at Rugby School in England. Rugby became popular and was soon adopted by other schools in England, which led in the 1850's to the the formation of the Football Association which adopted Rules for Rugby.

Princeton and Rutgers pioneered intercollegiate football in the United States in 1869 when the game played was soccer, albeit with twenty-five players on a side, instead of the present day eleven. Soon Yale, Cornell, Columbia and Michigan organized intercollegiate football teams. In 1873, Yale convened a meeting to form the Intercollegiate Football Association. On May 15, 1874, McGill University in Canada introduced the game of rugby to the United States. Americans soon became fascinated with the egg- shaped ball. Within two years, a slightly modified form of rugby had been adopted officially by Harvard, Yale, Princeton, Columbia and Rutgers under a new Intercollegiate Football Association. Various changes were developed, until in 1905, New York University called a special meeting of the football playing colleges of the nation, at which it was decided and to appoint a Football Rules Committee which adopted the beginning rules for what is now known as american football. Those rules have been considerably developed and refined over the ensuring years. The present invention utilizes the Rules of Football, hereinafter referred to as Rules of American FootbalL adapted a simulated football game played by opposing players or teams projecting darts onto the dartboard of the present invention.

SUMMARY OF THE INVENTION

The dartboard of the present invention simulates a rniniaturized playing field which is used for playing the game of american football. The dartboard further includes quadrilateral sections with different size targets for downs, punts and kicks. Each target is sized so as to require proficiency in the throwing of darts in order to achieve higher total score by one player or team of dart players against an opposing player or team within a previously agreed time period.

An objective of the present invention is to develop individual skills and proficiency in the throwing of darts which simulate the sills required in playing american football.

Another objective of the present invention is to require tactics and strategies by each player or team which simulate those needed in playing american football.

A further object of the present invention is to provide a simulated football game which can be played indoors, in comfortable and convivial surroundings, at any time of the year.

These and and other objectives and features of the present invention will be clarified in the following drawings and detailed description.

INDEX OF REFERENCE CHARACTERS

Figure 1:
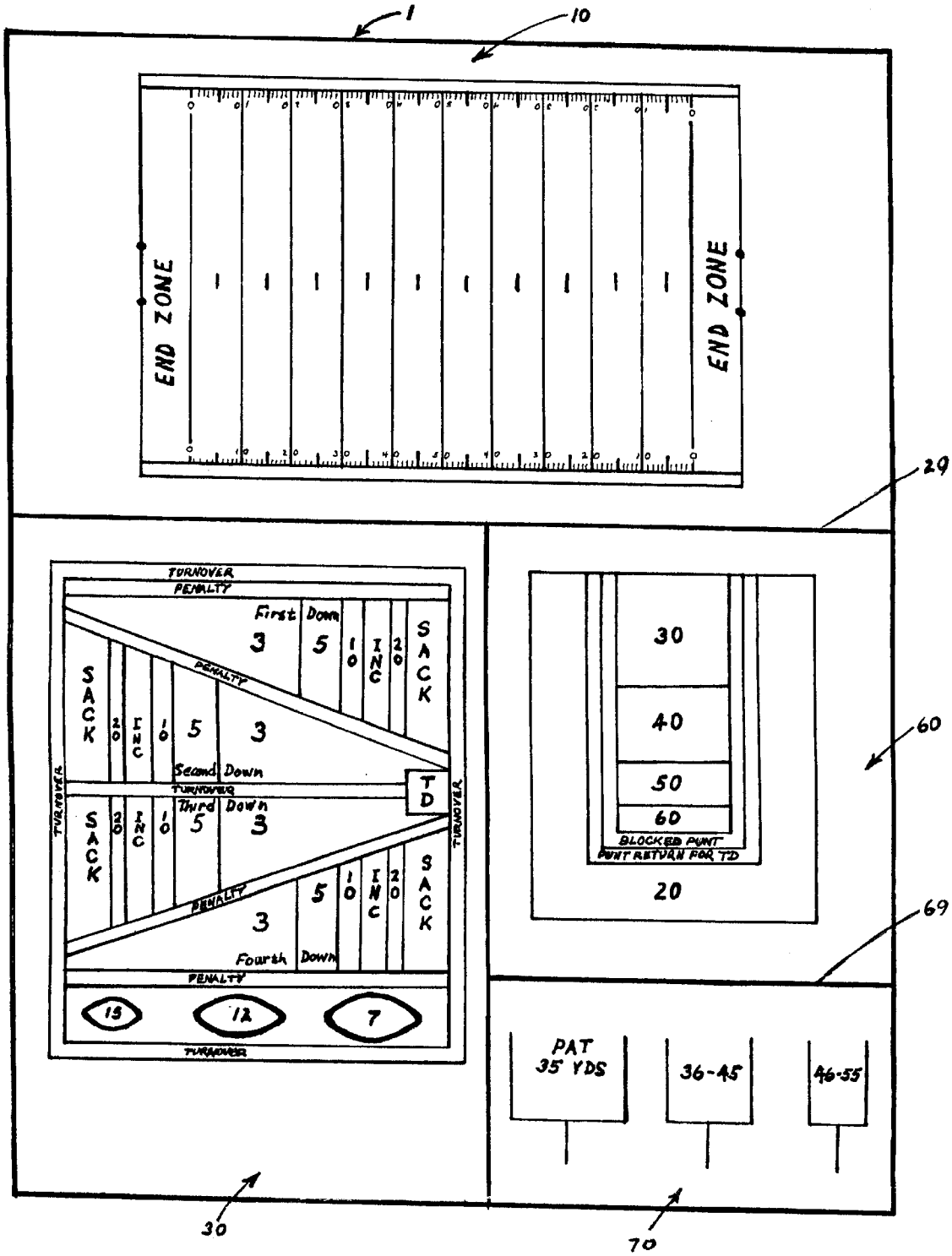
FIG. 1 is an elevation view of the dartboard of the present invention, which contains four separate sections: a Simulated playing field, a Downs section, a Punts section and a Kicks section.

1. Dartboard
10 Simulated playing field section
11 End zone
12 End zone
13 Goal Post
14 Goal Post
15 Goal post
16 Goalpost
17 Playing field enclosure
18 Ten yard lines
19 Five Yard strips
20 10 yard markers
21 5 yard markers
22 1 yard indicators
23 Sideline
24 Sideline
25 Narrow end
26 Narrow end
27 Long side
28 Long side
29 Playing field divider strip
30 Downs section
31 First Down triangle
32 Second Down triangle
33 Third Down triangle
34 Fourth Down triangle
35 7 yard gain target
36 12 yard gain target
37 15 yard gain target
38 Turnover indicator
39 Turnover indicator
40 Turnover indicator
41 Turnover indicator
42 Turnover indicator
43 Penalty marker
44 Penalty marker
45 Penalty marker
46 Penalty marker
47 Touchdown indicator
48 Special gain area
49 Downs section divider strip
60 Punts section
61 PUNT RETURN FOR TD target
62 BLOCKED PUNT target
63 20 yard punt target
64 30 yard punt target
65 40 yard punt target
66 50 yard punt target
67 60 yard punt target
68 PENALTY MARKER
69 Punts section divider strip
70 Kicks section
71 Point After Touchdown and 35 yard field goal target
72 36–45 yard field goal target
73 46–55 yard field goal target

DETAILED DESCRIPTION OF THE PREFERRED EMBODIMENT

Referring now to FIG. 1 there is shown the Dartboard of the present invention, generally referred to as 1. The Dartboard 1 includes a quadrilateral Smulated playing field section, generally referred to as 10; a quadrilateral Downs section, generally referred to as 30; a quadrilateral Punts section, generally referred to as 60; and a quadrilateral Kicks section, generally referred to as 70.

Figure 2:
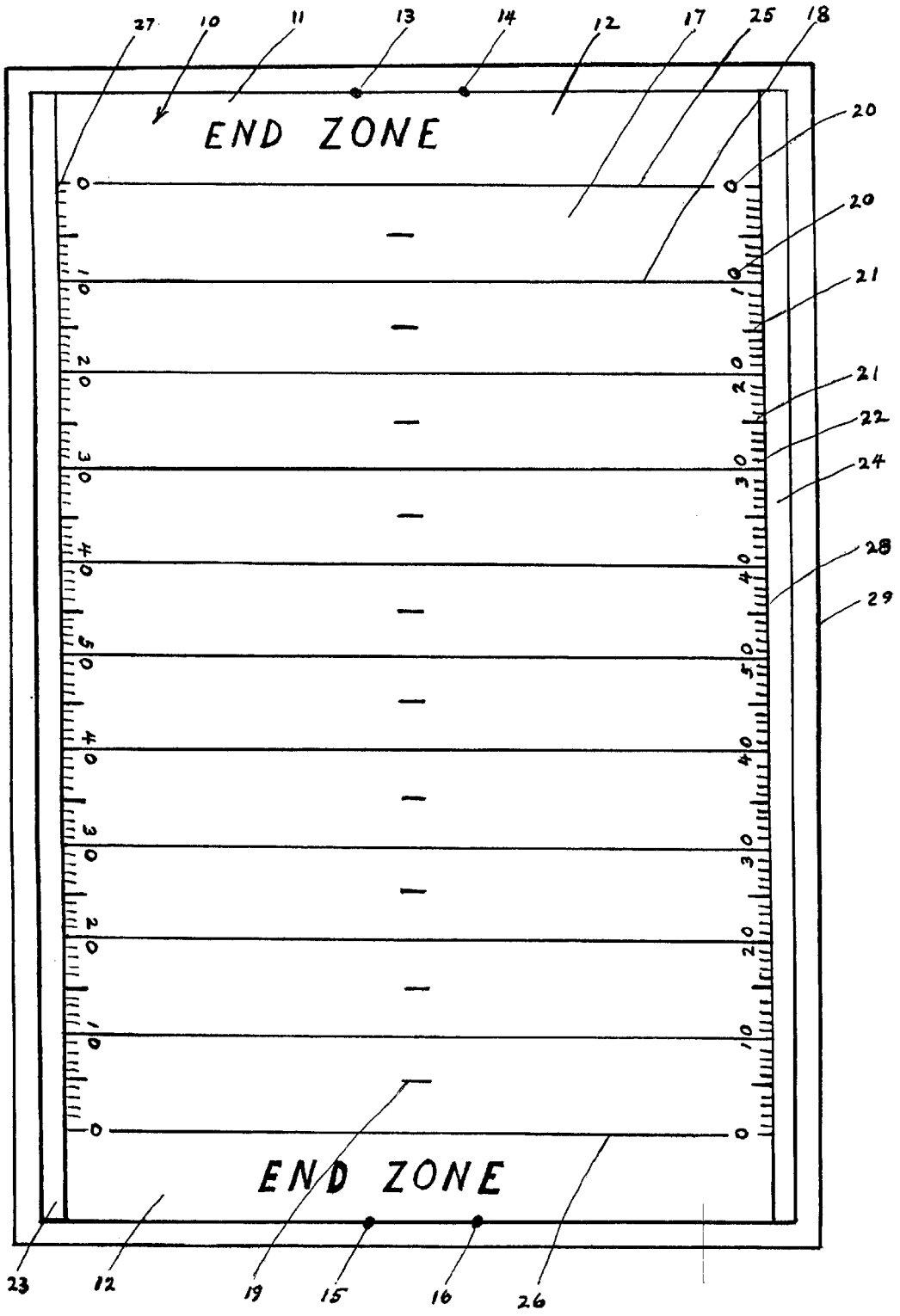
FIG. 2 is an enlarged elevation view of the Simulated playing field section of FIG. 1;.

Referring now to FIGS. 1 and 2, there is shown the quadrilateral Simulated playing field section 10, in the upper portion of the Dartboard 1. The Simulated playing field section 10, is used to represent the standard, rectangular 100 yard playing field of american football. The Playing field enclosure 17 has opposite Narrow ends 25, 26, and and opposite Long sides 27, 28. End zones 11, 12 are located at the opposite Narrow ends 25, 26, respectively, of the Playing field enclosurel7. A pair of Goal posts 13, 14 and 15, 16 are each positioned at the center of the outside periphery of the End zones 11, 12, respectively. The Long sides 27, 28 of the Playing field enclosure 17 are perpendicularly divided by parallel lines indicating Ten yard lines 18 indicated by 10 yard markers 20, Five yard strips 10 indicated by 5 yard markers 21, and 1 yard indicators 22. The Long sides 27, 28 have Sidelines or boundaries 23, 24, respectively. The Simulated playing field section 10 is separated from the Downs section 30 and the Punts section 60 by a Playing field divider strip 29.

Figure 3:
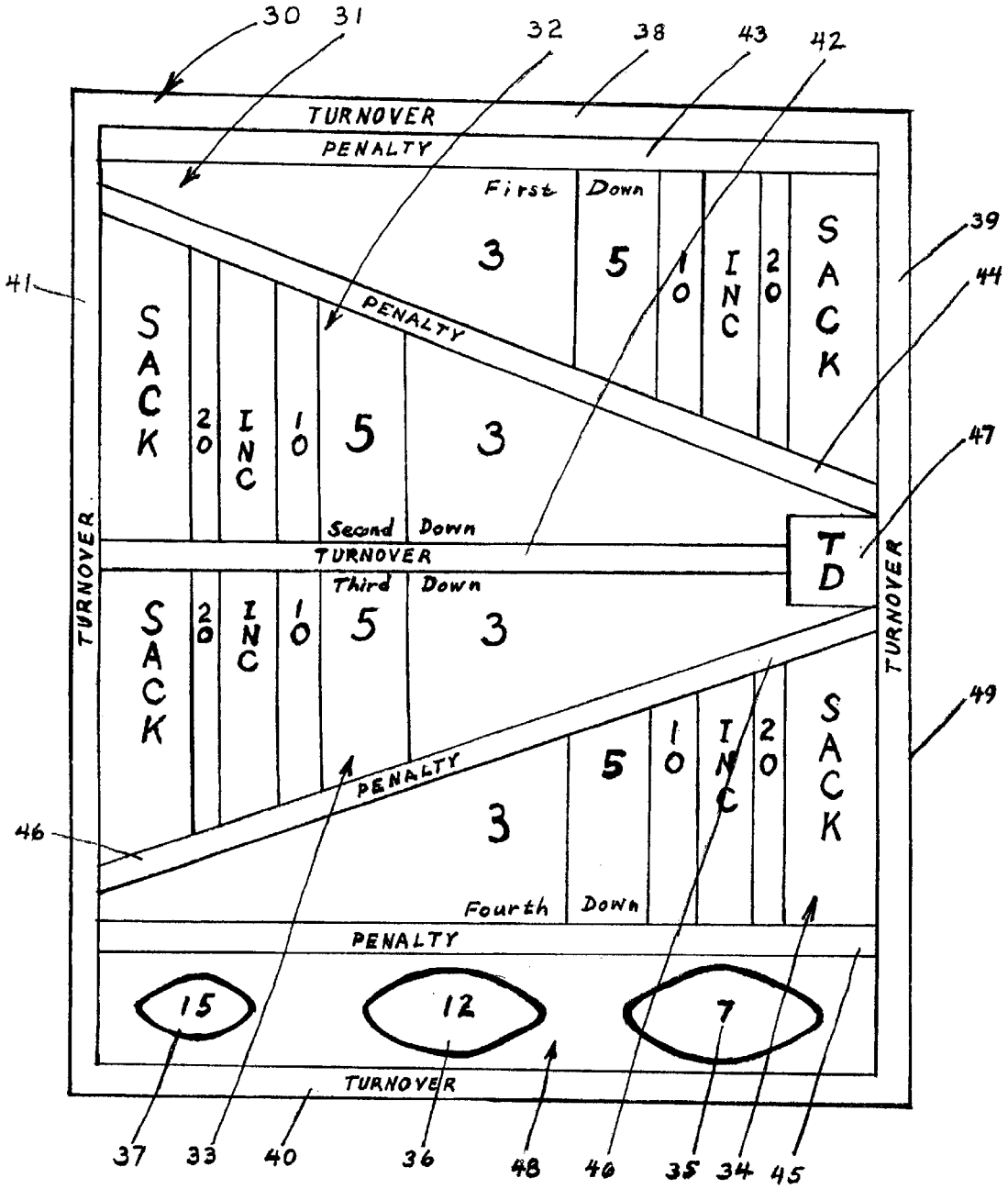
FIG. 3 is an enlarged elevation view of the Downs section of FIG. 1.

Referring now to FIGS. 1 and 3, there is shown the Downs section 30 in the lower left portion of the Dartboard 1. The Downs section 30 is a representation of the four downs provided in the Rules of American Football. The quadrilateral Downs section 30 is bounded on each of its four sides by narrow peripheral bands or areas 38, 39, 40 and 41 which are marked TURNOVER as an indicator of a turnover by a player in accordance with the Rules of American Football. There is a further Turnover indicator 42 represented by a narrow band dividing the top and the bottom of the Downs section 30 parallel and horizontally located between the Turnover indicator 38 and the Turnover indicator 40. At the right side of of the Turnover indicator 42 is a quadrilateral TD target 47 which represents a touchdown for a score of six points.for the shooter hitting that target.

The Downs section 30 has two horizontal bands or areas 43, 45 which are marked PENALTY as indicators of a penalty whenever struck by a dart from a shooter. Penalty marker 43 is located peripheral to and below Turnover indicator 38. Penalty marker 45 is located peripheral to and above Special gain area 48. Two additional Penalty markers 44, 46 are narrow bands which are located in a transverse direction from left to right of Downs section 30. Penalty marker 44 begins near the top of Turnover indicator 41, below Penalty marker 43 and proceeds in a downward direction and to the right toward the center of Turnover indicator 39, and ends just above the TD target 47. Penalty marker 46 begins near the bottom of Turnover indicator 41 and proceeds in an upward direction and to the right, ending near the center of Turnover indicator 39 and ends just below TD target 47.

A quadrilateral Special target gain area 48 is positioned at the lower portion of Downs section 30, below the horizontal Penalty indicator 45 and above the Turnover indicator 40, positioned between the Turnover indicators 39, 41. Within the Special target gain area 48 are horizontally located three footbal-shapeed targets indicating a 7 yard gain 35, a 12 yard gain 36, and a 15 yard gain 37.

In Downs section 30 there are four Downs triangular areas 31, 32, 33 and 34. A First down triangle 31 is formed by the area within the three legs of Penalty markers 43, 44 and the upper portion of Turnover indicator 39. A Second down triangle 32 is formed by the area within the three legs of Penalty marker 44 and Turnover indicators 41, 42. A Third down triangle 33 is formed by the area within the three legs of Turnover indicators 41, 42 and Penalty marker 46. A Fourth down triangle 34 is formed by the area within the three bands of Penalty markers 45, 46 and Turnover indicator 39. Each of the four Downs triangles 31. 32, 33 and 34 are subdivided into target areas which indicate 3, 5, 10 and 20 for yards gained; SACK; and INC. which means an incomplete forward pass. The Downs section 10 is separated from the Punts section 16 and the Kicks section 70 by Downs divider strip 49.

It is a feature of the present invention that all of the target are have different sizes which require skill or proficiency of the player or shooter of the darts onto specific targets on the Dartboard 1.

Figure 4:
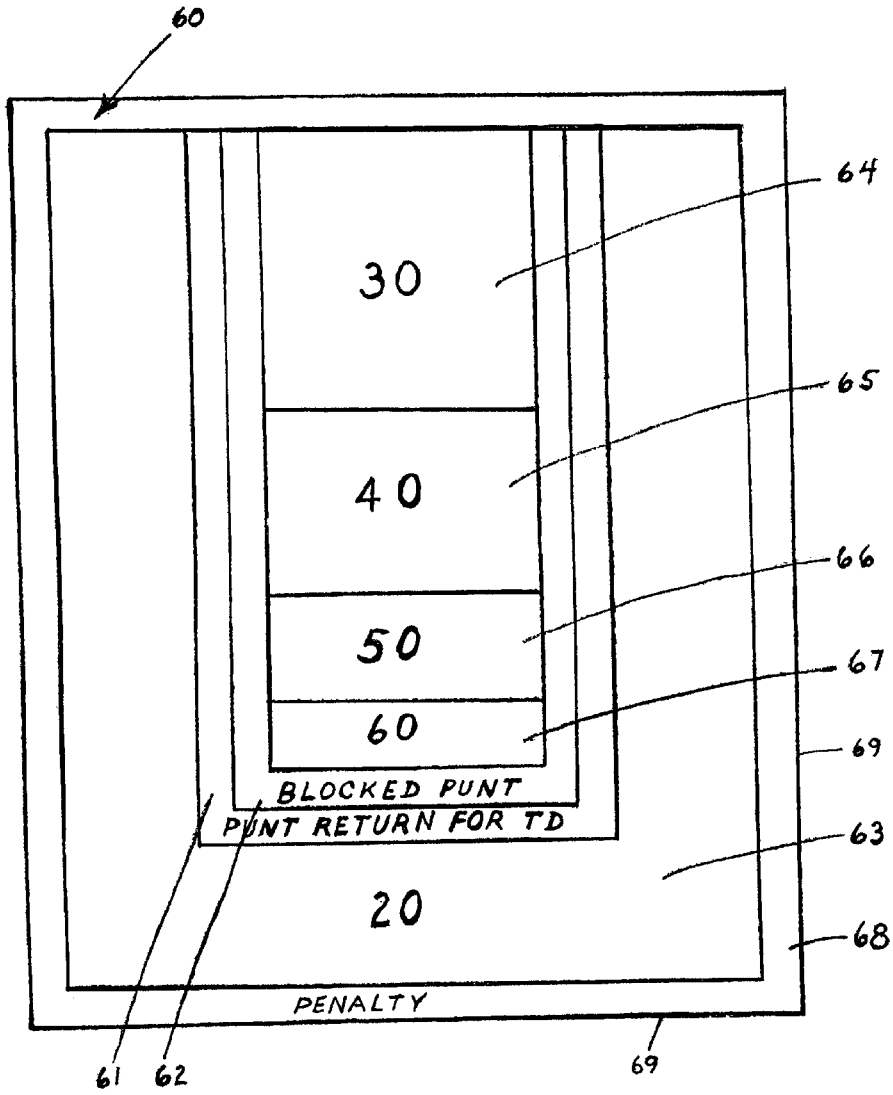
FIG. 4 is an enlarged elevation view of the Punts section of FUG. 1.

Referring now to FIGS. 1 and 4, there is shown the Punts section 60 of the Dartboard 1 of the present invention. The Punts section 60 is bounded by a rectangular band marked as PENALTY marker 68. Enclosed within the PENALTY marker 68 are sevene concentric targets indicating: PUNT RETURN FOR TD target 62; BLOCKED PUNT target 61; 20 punt yard target 63; 30 yard punt target 64; 40 yard punt target 65; 50 yard punt target 66; and 60 yard punt target 67. Each of the latter targets are sized in area to provide greater skill or proficiency of the dart thrower to achieve longer punts or a touchdown. The Punts section 60 is separated from the Kicks section 70 by a Divider strip 69 on the Dartboard 1.

Figure 5:
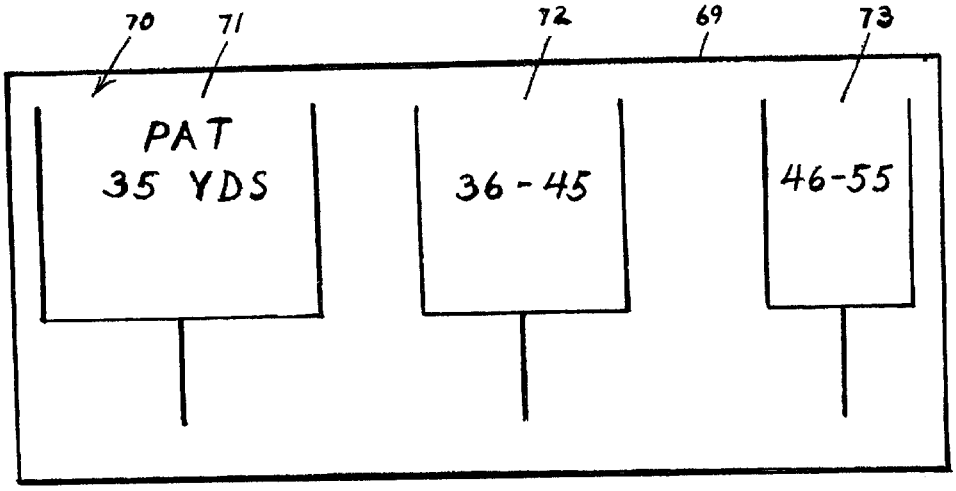
FIG. 5 is an enlarged elevation view of the Kicks section of FIG. 1.

Referring now to FIGS. 1 and 5, there is shown the Kicks section 70 of the Dartboard 1. The Kicks section 70 has positioned thereon three goal post-shaped targets 71, 72 and 73. Target 71 is the largest target and is labeled PAT - 35 YDS indicating a Point After Touchdown for 1 point after scoring a Touchdown, or indicating a 35 yard field for 3 points scored by the player. Target 72 is labelled 36–45 indicating a field goal for 3 point scored by the thrower when he is within that distance from his Goal posts, either 13, 14 or 15, 16 on the Simulated playing field 10. Target 72 is labeled 46–55 indicating a field goal for 3 points scored by a player when within that distance from the goal posts, either 13, 14 or 15, 16 on the Simulated playing field 10.

METHOD OF OPERATION

The simulated football game of the present invention is played in accordance with the Rules of American Football and in the following manner:

A simulated football game begins with a coin toss to determine the first player or shooter of darts. A n initial time period of play is set at 15 minutes The first player begins play at his own 20 yard line on the Simulated playing field 10 He receives an initial set of four darts which he uses as an initial set of four downs in which he must gain a rrmiimum of 10 yards by shooting darts onto the Dartboard 1, in order to receive another set of four darts to gain another 10 yards for each succeeding set of four downs The first player shoots his set of four darts, one dart at a time, and successively, at each of the Downs triangles 31, 32, 33, lnd 34 in Downs Section 30., Alternatively, the first player may shoot at the Special gain target area 48, or at the the TD for touchdown target 47. Only one attempt, and only with the fourth dart, may the player shoot at the TD target 47, or at the Special gain target area 48 during each set of four downs.

A thrown dart corresponds to a down regardless of where it lands. A thrown dart that does not remain in the Dartboard 1 shall count as zero yards gained. In the final two minutes of a game each one of the set of four darts may be thrown at the TD or touchdown target 47. Positive yardage may only be gained by indicating yardage gained on the Simulated playing field 10 for each down or dart thrown. Additional yardage is likewise indicated on the Simulated playing field 10 after each dart is thrown.

The players play or throw four darts, corresponding to a set of four downs, in succession following the a player who has not achieved, either: a gain of a total of 10 yards within a set of four downs, or the player has scored a TD, or the player has punted, or the player has kicked a field goal, or the playerr has made a turnover. When a player has struck the TD target 47, he scores 6 points, and he must then attempt another point by throwing a dart at the PAT or Point After Touchdown target 71 in the Kicks section 70. If a player does not achieve a total of 10 yards gained with his first three darts thrown during each set of four downs, he may attempt to: throw at the Special gains target area 48; or throw a dart at the TD target 47; or he may elect to punt by throwing at the targets in Punts Section 60; or he may attempt a field goal if he is within a distance indicated in the Kicks section 70.

If the player strikes a Penalty marker 43, 44, 45, 46, 48 the shooter will lose 5 yards in field position on the Simulated playing field 10, and he will repeat that down. The non-shooting player determines whether a penalty is enforced or declined. If declined, no yardage is lost by the shooting player, but he loses a down. Any dart which strikes within a SACK target in any of the Downs triangles 31, 32, 33, or 34 results in a loss of 5 yards in position plus a loss of down by the shooting player. A dart that strikes an INC target in any of the Dons triangles 31, 32, 33, or 34 is considered an incomplete pass and zero yards gained.

After one player achieves a touchdown by striking the TD target 47, or he gains sufficient yards during each set of downs to reach his End zone 11 or 12, he is awarded 6 points, and he must attempt to strike the PAT or Point after Touchdown target 61 for one additional point A player may attempt a target in the Punts section 60 with the last dart in each set of four darts or downs. A player who attempts a punt by a dart thrown to Punts section 60, but who misses the Punts section 60, or who hits the BLOCKED PUNT target 61 has zero yards added to his position on the Simulated playing field 10. Thereupon, the next player begins his set of four downs with a set of four darts.

A player who attempts a field goal by throwing a dart at the Kicks section 70 must add 10 yards to his position on the Simulated playing field 10 to allow the additional distance of 10 yards in his End zone, either 11 or 12. A PAT or Point After Touchdown and a 36–45 yard field goal are achieved by shooting a dart at the largest sized target 72 in the Kicks section 70. Field goal attempts of 36–45 yards are taken by throwing a dart at the middle sized target 72. Field goal attempts of 46–55 yards are are taken by shooting a dart at the smallest sized target 73.

All penalties are counted as a negative 5 yards to the shooter's position on the Simulated playing field 10. If a player hits the PENALTY target 68 in the Punts section 60 a penalty of 5 yards is assessed against the player's position, regardless of whether or not he is punting. When a player shoots at the Punts section 60, the yardage achieved is added to his position on the Simulated playing field 10, which is the position where the next shooter begins his set of four downs. If a shooter hits the Blocked punt target 62, he is assessed a negative 5 yards to his position on the Simulated playing field 10, from which point the next player begins his set of four downs. If a shooter hits the PUNT RETURN FOR A TD target 61, the non-shooter is awarded 6 points and he must attempt to hit the PAT target 71 to be awarded another one point to his score. One point is awarded for each point after touchdown and three points are awarded for each field goal. A non-shooter will be awarded two points for a safety if the shooter hits a SACK target in any of the Downs triangles 31, 32, 33, 34 when his position is within 5 yards of his own End zone 11 or 12. Penalties assessed against a shooter when his position is within five yards of his own End zone 11 or 12 on the Simulated playing fired 10 are assessed at one-half of the distance to his own End zone 11 or 12.

If the first shooter achieves a touchdown or a field goal, or has a safety assessed against him, the next player begins play at his own 20 yard line on the Simulated playing field 10. As each shooter accumulates yardage gained, the non-shooter marks the appropriate position of the shooter on the simulated playing field 10. The shooter may not shoot another dart until his appropriate position has been marked by the non-shooter.

If a game is tied after 15 minutes of play, a sudden death overtime of 5 minutes is required. The players flip a coin to determine the first shooter. The first player to score is the winner of the simulated football game.

In the event that a situation arises which is not covered by the above METHOD OF OPERATION, the situation is resolved by reference to the Rules Of American Football.

The present invention shall not be limited by the above descriptionof the preferred embodiment for which those skilled in the art of football games may find alternate equivalent features comprehended by the spirit of the present invention. The invention is defined by the following claims which are appended hereto.

What is claimed is:

1. A dartboard adapted for playing the game of simulated american football by the use of darts projected by two opposing players or teams upon the dartboard, which comprises:

a. a quadrilateral simulated football field section upon which a first player or team indicates their offensive position at the commencement of the game;

b. a quadrilateral downs section divided into four triagular downs targets indicating gains, turnovers, and penalties, together with a single target indicating a touchdown;

c. a quadrilateral punts section divided into a multiplicity of targets indicating a penalty, a blocked punt, a return for a touchdown, and various distances of punts; and d. a quadrilateral kicks section divided into a multiplicity of targets indicating a point after touchdown and varying distances for field goals;

whereby the first player or team utilizes a set of four darts to be individually projected upon said downs section of the dartboard to achieve either a first down, a field goal score, or a touchdown score; or should the first player or team fail to achieve a first down, a field goal, or a touchdown with his first three darts, the first player or team has the option to direct his fourth dart upon said downs section for a touchdown, or upon said punts section for a punt, or upon said kicks section for a field goal; and whereby the second player or team follows said first player or team in the same manner until either of said players or teams achieves a winning score within a previously agreed time period.

* * * * *